US011189127B2

(12) United States Patent
Karrbrink et al.

(10) Patent No.: US 11,189,127 B2
(45) Date of Patent: Nov. 30, 2021

(54) TARGET SHOOTING GAME WITH BANKING OF PLAYER ERROR

(71) Applicant: Green Jade Games Ltd, Ta' Xbiex (MT)

(72) Inventors: Jesper Karrbrink, Stockholm (SE); Andy Hieke, San Francisco, CA (US); Joe Kisenwether, Sparks, NV (US)

(73) Assignee: Green Jade Games Ltd

( * ) Notice: Subject to any disclaimer, the term of this patent is extended or adjusted under 35 U.S.C. 154(b) by 0 days.

(21) Appl. No.: 16/558,514

(22) Filed: Sep. 3, 2019

(65) Prior Publication Data

US 2020/0402349 A1 Dec. 24, 2020

Related U.S. Application Data

(63) Continuation-in-part of application No. 16/449,336, filed on Jun. 21, 2019.

(51) Int. Cl.
*G07F 17/32* (2006.01)
*G07F 17/34* (2006.01)

(52) U.S. Cl.
CPC ..... *G07F 17/3213* (2013.01); *G07F 17/3209* (2013.01); *G07F 17/3237* (2013.01); *G07F 17/3258* (2013.01); *G07F 17/3267* (2013.01); *G07F 17/34* (2013.01)

(58) Field of Classification Search
None
See application file for complete search history.

(56) References Cited

U.S. PATENT DOCUMENTS

| | | | | |
|---|---|---|---|---|
| 8,075,383 | B2 | 12/2011 | Friedman | |
| 2011/0053676 | A1* | 3/2011 | Wolf | G07F 17/3258 463/20 |
| 2011/0111826 | A1* | 5/2011 | Baerlocher | G07F 17/34 463/20 |
| 2015/0080105 | A1* | 3/2015 | Itagaki | G07F 17/326 463/20 |
| 2018/0047253 | A1* | 2/2018 | Vann | G07F 17/3262 |
| 2019/0005772 | A1* | 1/2019 | Cire | G07F 17/3258 |

* cited by examiner

*Primary Examiner* — Jason T Yen
(74) *Attorney, Agent, or Firm* — Muskin and Farmer LLC

(57) ABSTRACT

A method, system, and computer readable storage to implement an electronic wagering game. The wagering game presents around which comprises targets which fall from a top of an electronic output device towards a bottom, and if any target passes a horizontal lose line then the round terminates. If the player completes the round without a target reaching the lose line then the player is presented with an optimal award.

20 Claims, 13 Drawing Sheets

TARGET SHOOTING GAME WITH BANKING OF PLAYER ERROR

CROSS REFERENCE TO RELATED APPLICATIONS

This application is a continuation in part of U.S. application Ser. No. 16/449,336, which is incorporated by reference herein in its entirety.

BACKGROUND OF THE INVENTION

Field of the Invention

The present general inventive concept is directed to a method, apparatus, and computer readable storage medium directed to a video game apparatus, method, and computer readable storage which can bank player error.

Description of the Related Art

Video games (played online, on 'apps' (such as on mobile phones, tablets, etc.) or played on electronic gaming machines are a billion dollar industry. Once such genre of games are "nonstop" games in which targets will move vertically from the top of the screen to the bottom of the screen and the player has to destroy all of the targets by shooting them before a target moves below a horizontal line on the screen. Once a target passes the horizontal line, the game ends.

Video games which allow for wagering of real money are also becoming more popular as the two genres (video games, gambling games) are being merged together.

SUMMARY OF THE INVENTION

It is an aspect of the present invention to provide an improved video game for wagering.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
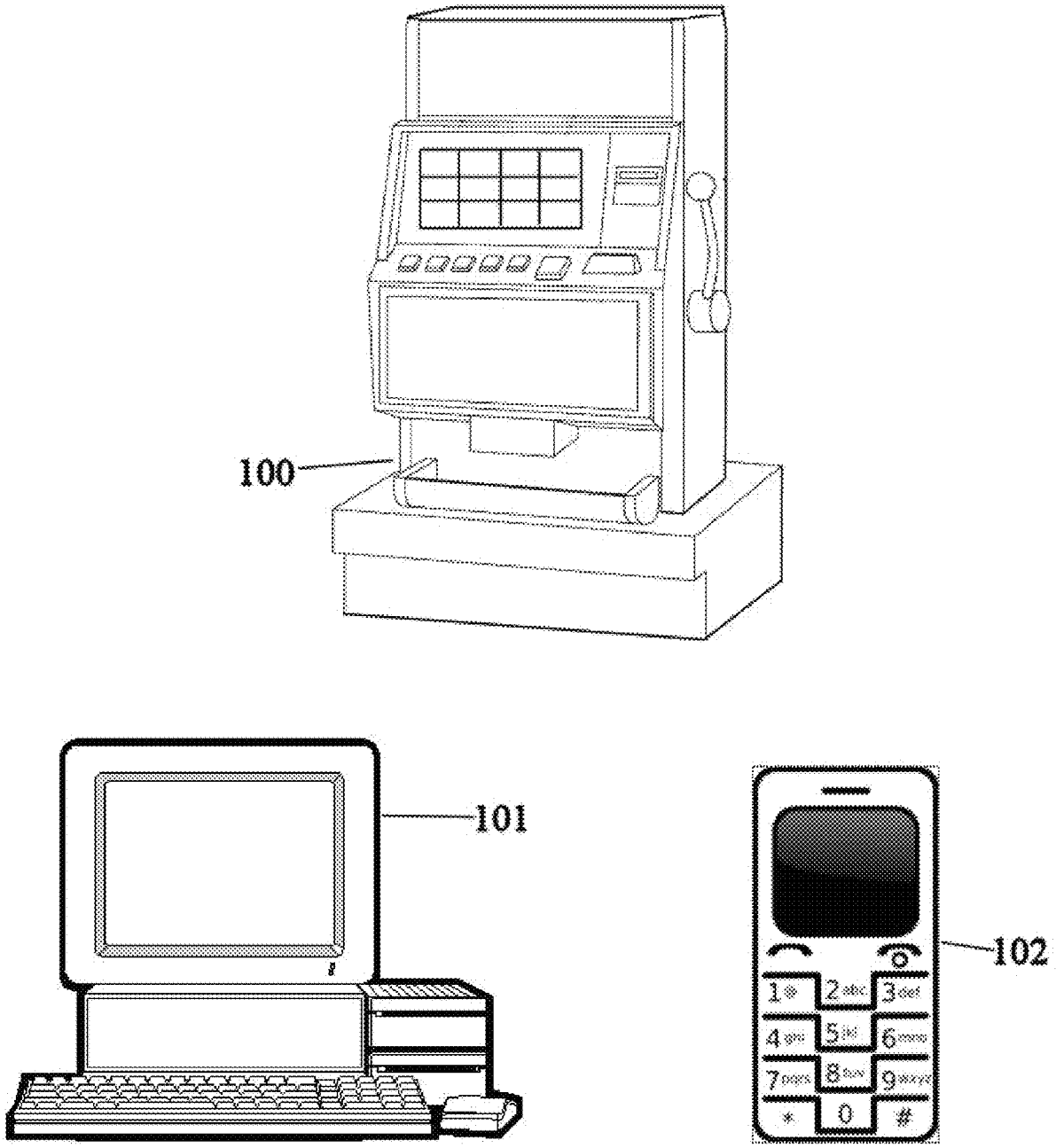
FIG. 1 is an example of different systems in which the methods described herein can be played (applied), according to an embodiment.

Reference will now be made in detail to the presently preferred embodiments of the invention, examples of which are illustrated in the accompanying drawings, wherein like reference numerals refer to like elements throughout.

The general inventive concept relates to a video game which enables the player to place a wager in credits, play the game, and then potentially win credits based on what has taken place during the game. The game involves targets that will move vertically from the top of the screen to the bottom. If a target reaches the bottom of the screen (or a horizontal line towards the bottom of the screen) then the game ends. The player's goal is to continuously shoot targets as they move down the screen before one reaches the bottom. There is a finite number of targets for each round, and if the player can shoot all of the targets without letting any reach the bottom the player will have won (passed) the round. The game incorporates error banking (as described below) so that players who do not play optimally will have their error contributed to an error pool that players can win in later rounds. This will guarantee a consistent RTP (return to player) of the game over time (on an overall basis, not a player by player basis, so that some individual players may not achieve the consistent RTP but the overall average player of the game among all players would). For example, a pool contains what remains of "uncollected winnings", that is, potential awards (e.g., credits) which the player did not earn because the player did not play optimally. These uncollected winnings can be contributed to the pool so that other players can earn them. For example, if the optimal award (value) of a round s $4 but the player only earns $1.5 in that round, then the $2.5 difference would go into the pool which (in its entirety or partially) would be distributed to the banks for the next player who plays the game. More on the bank distributed is discussed below.

The game described herein can be played by players on a typical electronic gaming machine (e.g., slot machine), a personal computer (or laptop) 101, or a cell (mobile) phone 102. Each of these devices would be connected to a network which would be connected to a server 500. The connection can be via a physical LAN, wireless connection (e.g., WIFI, Bluetooth, etc.) simple cables, etc.

Figure 2:
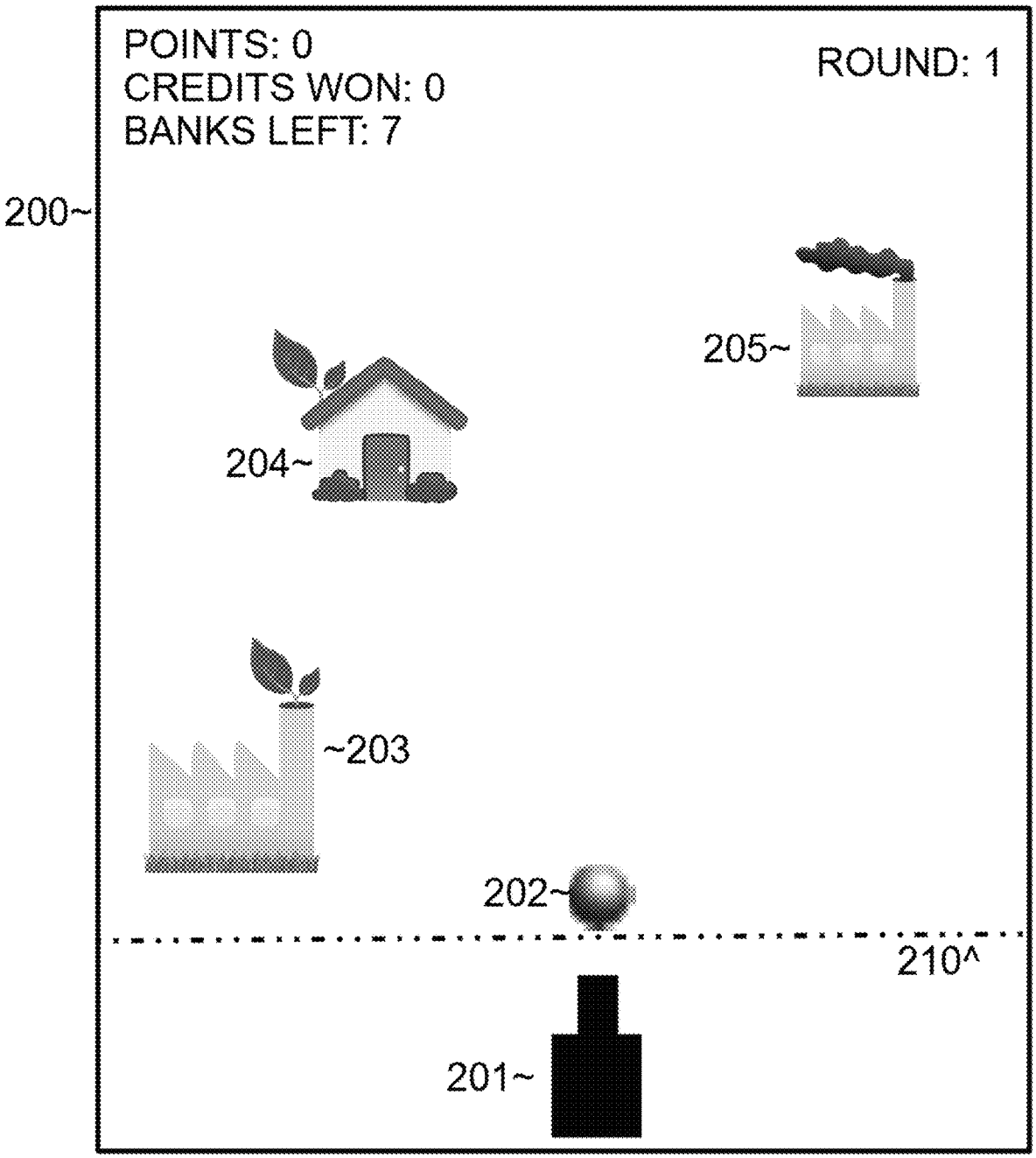
FIG. 2 is a drawing showing a shooting game, according to an embodiment.

FIG. 2 is a drawing showing a shooting game, according to an embodiment. FIGS. 2-6 can all be considered to happen in time sequence.

A game window/screen 200 displays a tank 201 (although it can be any player icon such as a plane, person, etc.) is controlled by the player (the player can move and shoot left and right by using an input device). The player can also aim the cannon on the tank in any direction. The player has instructed the tank 201 to shoot (by using the input device) and a bullet 202 has been launched from the tank 201. The player's goal is to destroy all targets (buildings) before they move past the "lose line" 210. All targets will move vertically from top to bottom. If a target reaches the lose line 210 before it is destroyed by the tank 201 then the round terminates.

There are different types of targets, for example a bank 203, a house 204, a factory 205, etc. Different types of targets may have different effects when destroyed, but all targets must be destroyed by the player before reaching the lose line 210 or the round will terminate. The player can shoot numerous bullets 202 simultaneously.

In the upper left is a display of (total) points, credits won, and banks left. Each time a player destroys a target it will add to the points. Note however, that the amount of points is for recreational purposes, as points have no cash or monetary value. Also displayed is a number of credits won for the game. Credits can be converted into cash so of course the player's goal is to win as many credits as possible. In order to play the game the player must pay a predetermined quantity of credits. When a player first wants to play the game, the player will purchase credits (e.g., using a cryptocurrency, credit card, wire transfer, electronic funds transfer, or any other method). The player can also choose any point to cash out, that is, convert their credits into cash/monetary amount (e.g., by requesting and then receiving the equivalent cash value transferred via electronic funds transfer, etc.) Each time a player destroys a bank then the player would be awarded credits. The player can only be awarded credits is destroying banks. Not all banks carry/award credits upon their destruction. In an optional embodiment, the display can also display the number of remaining banks left to destroy in the level. Each round has a predetermined finite number of banks to destroy (e.g., 1-10 or more) and each time the player destroys a bank the number of banks left will decrease by one. Note that banks are a type of target (which awards an award), but of course instead of "banks" this type of award awarding target can be any other structure (e.g., oil well, building, gold mine, etc.) This type of target (e.g., banks) that award credits can also be referred to as a credit awarding target. Typically, all awards to the player are made in credits. Points can be earned by the player for destroying targets but they are not awards.

Figure 3:
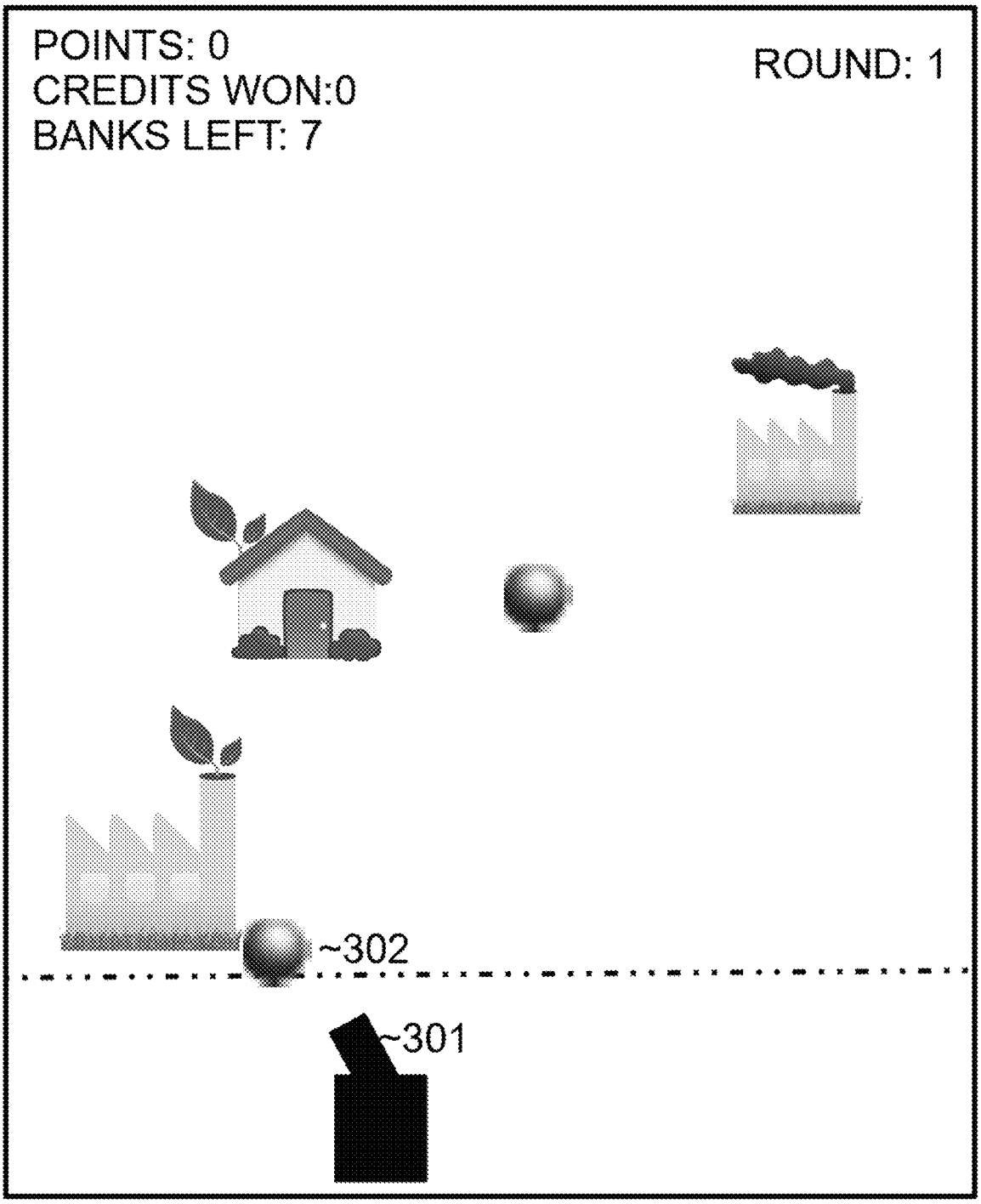
FIG. 3 is a drawing showing the shooting game as the targets progress downward, according to an embodiment.

FIG. 3 is a drawing showing the shooting game as the targets progress downward, according to an embodiment.

FIG. 3 shows the cannon 301 of the tank 201 being aimed towards the bank 203, and a bullet 302 (shot) fired towards the bank 203. All of the targets (buildings) continuously move down towards to bottom of the screen. Banks are targets and they also move from top to the bottom of the screen. Bank 203 is getting close to the lose line 210, and if bank 203 touches the lose line 210 then the round terminates. In one embodiment, a bottom of the target just has to touch the lose line 210 to cause termination, in another embodiment the target has to entirely cross (in other words, a top of the target touches the lose line 210) the lose line 210 to terminate. Note that while the game shown moves targets from top to bottom, in another embodiment, the targets can move from bottom to top, left to right, right to left, etc.

Figure 4:
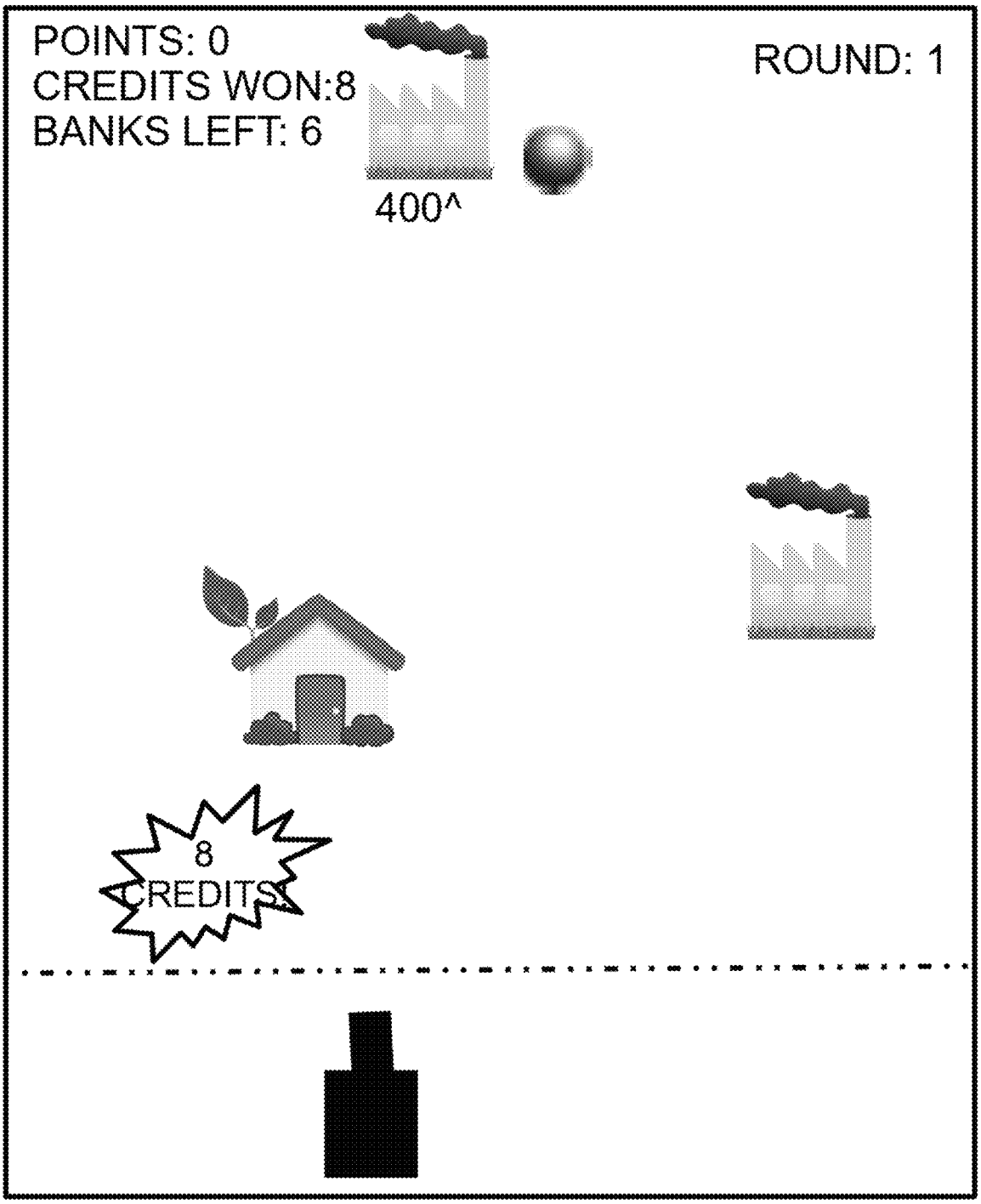
FIG. 4 is a drawing showing a bank being destroyed by the tank, according to an embodiment.

FIG. 4 is a drawing showing a bank being destroyed by the tank, according to an embodiment.

The bullet 302 has touched the bank 203 meaning that the bank 203 has now been destroyed. In one embodiment (as illustrated in FIGS. 2-3), a single bullet touching (contacting) a target would destroy it. In another embodiment, multiple hits (multiple bullets) would be needed to touch a target before the target is destroyed. It is also noted that a new target 400 is added at a top of the screen and would move downward. New targets continuously scroll from the top down to the bottom of the screen. In one embodiment, new targets are added randomly. In another embodiment, the entire level is all predetermined and the time and location in which all targets appear on the screen is all predetermined (thus, with continued play, a player can improve by memorizing where the targets will appear).

Note that in FIG. 4 a bank is destroyed. This means that the player can be given an award of credits (credits are exchangeable for money and can be redeemed for real money/cash). Thus, players will hope to destroy the banks to receive an award of credits. Each time a bank is destroyed, the award for the destruction of that bank is awarded to the player by adding the credit award to the player's credit meter (typically the award assigned to each bank is already predetermined). There were 7 banks at the start of the round to destroy, now that one is destroyed the banks remaining meter at the top left of the screen shows 6.

Figure 5:
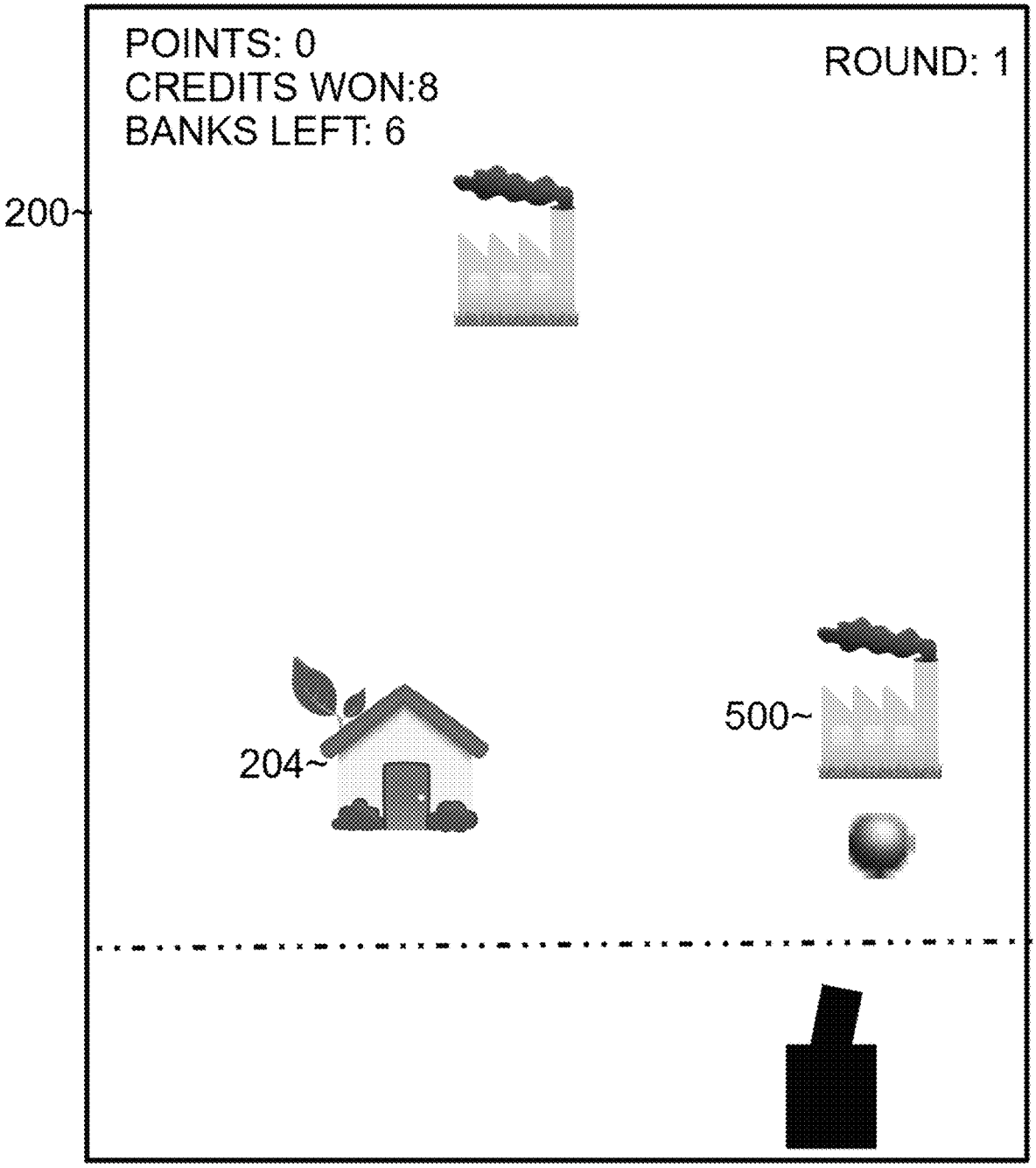
FIG. 5 is a drawing showing a further progression of the game, according to an embodiment.

FIG. 5 is a drawing showing a further progression of the game, according to an embodiment.

The destroyed bank 203 and its explosion have been removed from the display and the targets continue to move down on the screen. The player can move his/her tank 201 left and right and also point the cannon 301 left and right in order to aim the tank's shots. The tank 201 can shoot multiple targets at a time.

Factory 500 is another type of target. Since a factory 500 is not a bank, destroying a factory (and any other target type that is not a bank) will not generate an award in credits like destroying a bank will. However, all targets must be destroyed before they reach the lose line or the game will terminate. In addition, the player typically gets points for destroying targets (which are not banks). Points are typically for entertainment purposes as points cannot be exchanged for credits and cannot be redeemed for cash or anything of value.

Figure 6:
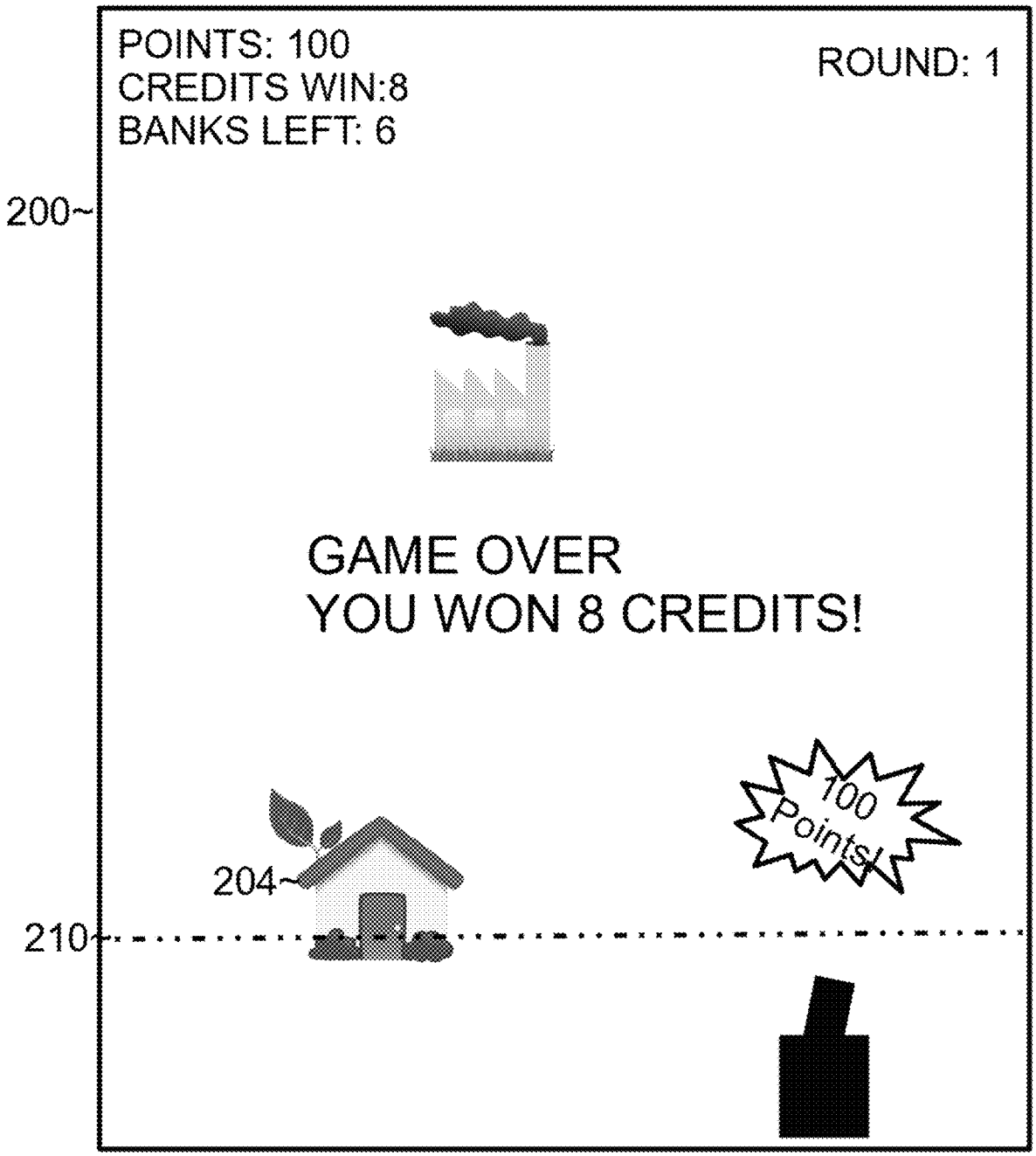
FIG. 6 is a drawing showing a target passing the lose line, according to an embodiment.

FIG. 6 is a drawing showing a target passing the lose line, according to an embodiment.

The factory 500 has been destroyed and the player earns 100 points which is added to the point meter on the upper left. Note that each target can be worth a standard (constant) amount of points. For example, each factory can be worth 100 points (or a random amount) when destroyed which is then added to the point meter.

The game continues in this fashion until the round/level is completed. That is, there is a finite total number of targets that will scroll down from the top that the player has to destroy for a level/round. If the player successfully destroys all of the total number of targets without any target reaching the lose line then the player will have completed (won) that round/level (this can also be referred to as completing/passing a checkpoint). Thus, the overall game can be considered a "skill game" in that mechanical skill would be used by the player which would help the player in completing the goal (to destroy all of the targets before they reach the lose line). Thus, a player who is more skilled at this type of task would generally over time do better (win more credits) than a player who is relatively lesser skilled.

This is balanced by distributing the error pool to banks early in the game round giving less skilled players all or part of the error pool. In this way, the overall (average) return to player (RTP) of the game (for all players over time) can be constant because all of the "errors" by players (by not playing optimally) are returned to other players by adding those errors (in credits) to banks (the award in which each bank awards when the bank is destroyed by the player).

When the player completes a level/round, the player would then be entitled to play a bonus game as a reward for completing the level/round. The bonus game can be a non-skill game meaning the result (amount of credits the player wins) can be entirely determined by random determination.

If any target passes the lose line, then the game ends and the player does not proceed to the bonus game. In the example in FIG. 6, the house 204 (although it could be any other target) passes (goes below) the lose line 210 on the bottom, which triggers the game to end and the player can collect how many credits the player has earned. Had the player successfully shot (destroyed) the house 204, then the game play would continue without ending at this point.

Figure 7:
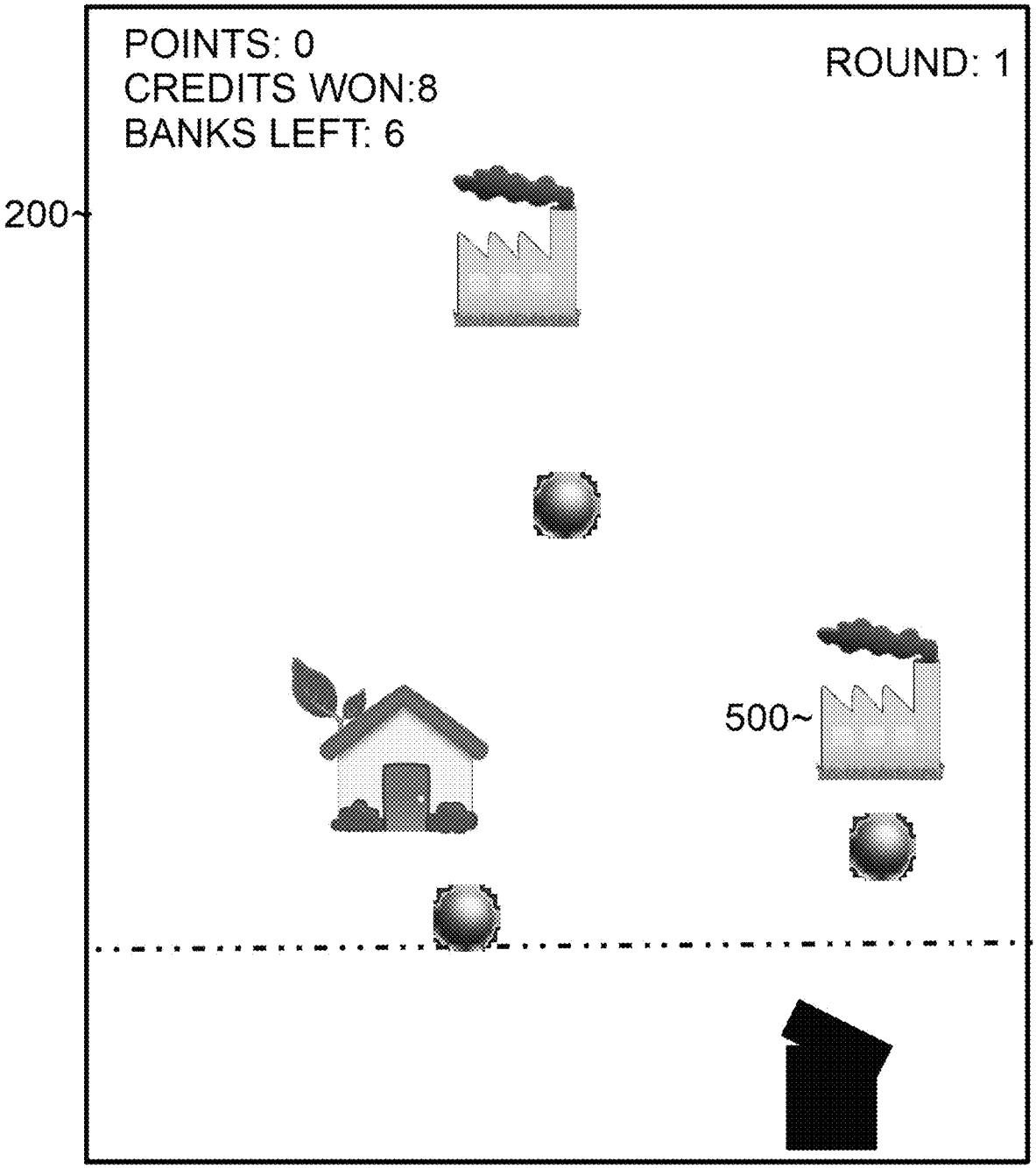
FIG. 7 is a drawing showing a showing the player shooting at all visible targets, according to an embodiment.

FIG. 7 is a drawing showing a showing the player shooting at all visible targets, according to an embodiment. FIG. 7 follows from FIG. 5.

In FIG. 7, the player has/will successfully shoot/destroy all targets on the screen.

Figure 8:
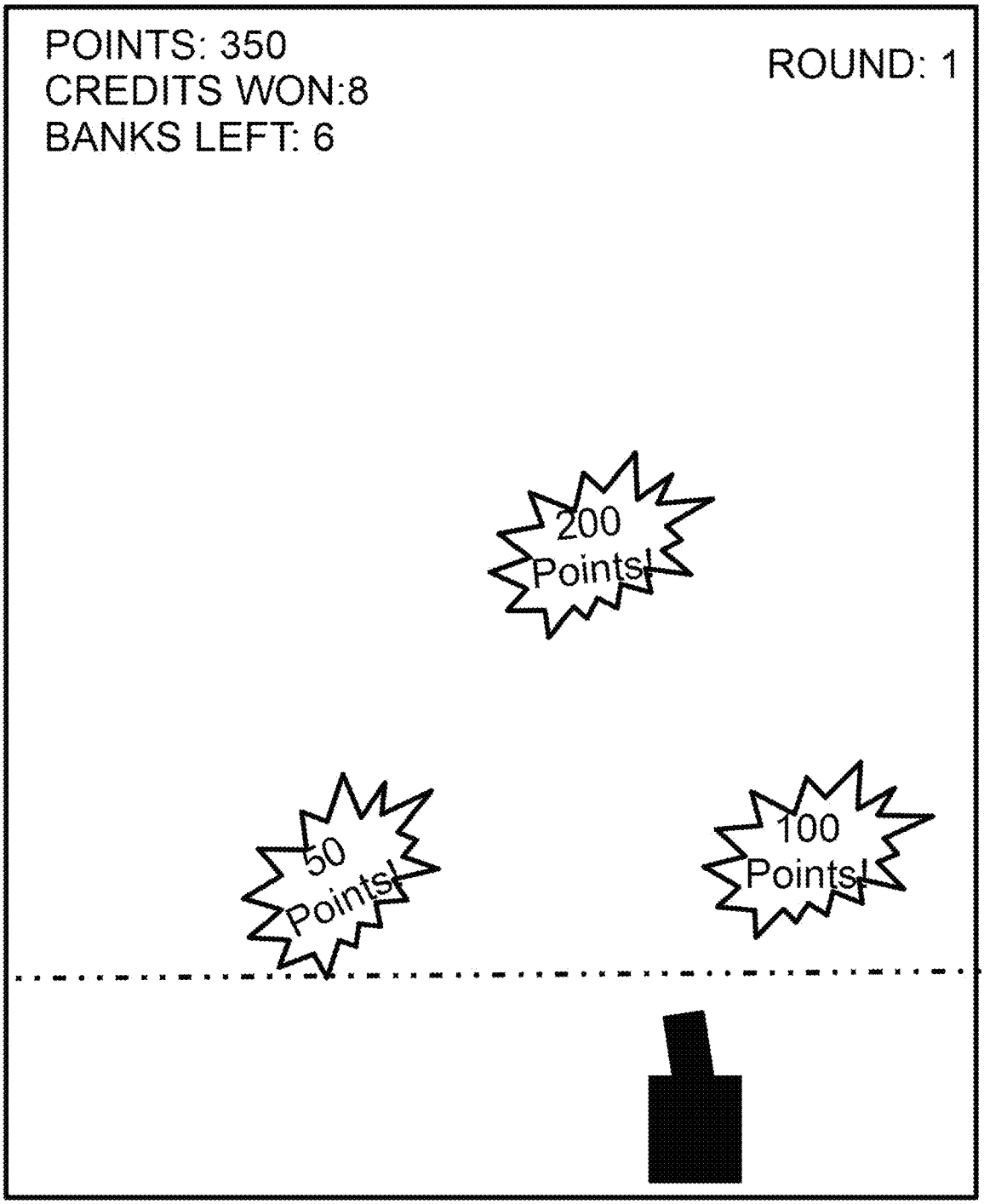
FIG. 8 is a drawing showing all targets destroyed, according to an embodiment.

FIG. 8 is a drawing showing all targets destroyed, according to an embodiment.

In FIG. 8, the projectiles that were shot (launched) from the launcher (e.g., cannon, gun, etc.) in FIG. 7 have destroyed their respective targets. Each destroyed target awards a random (or predetermined) award of points. Note, however, that the points are for recreational purposes only, the points cannot be exchanged for cash or anything of value. No banks were destroyed in FIGS. 7-8, but if any banks were destroyed then those bank(s) would award the player (by increasing the player's credit meter) those banks' assigned credit amount.

Figure 9:
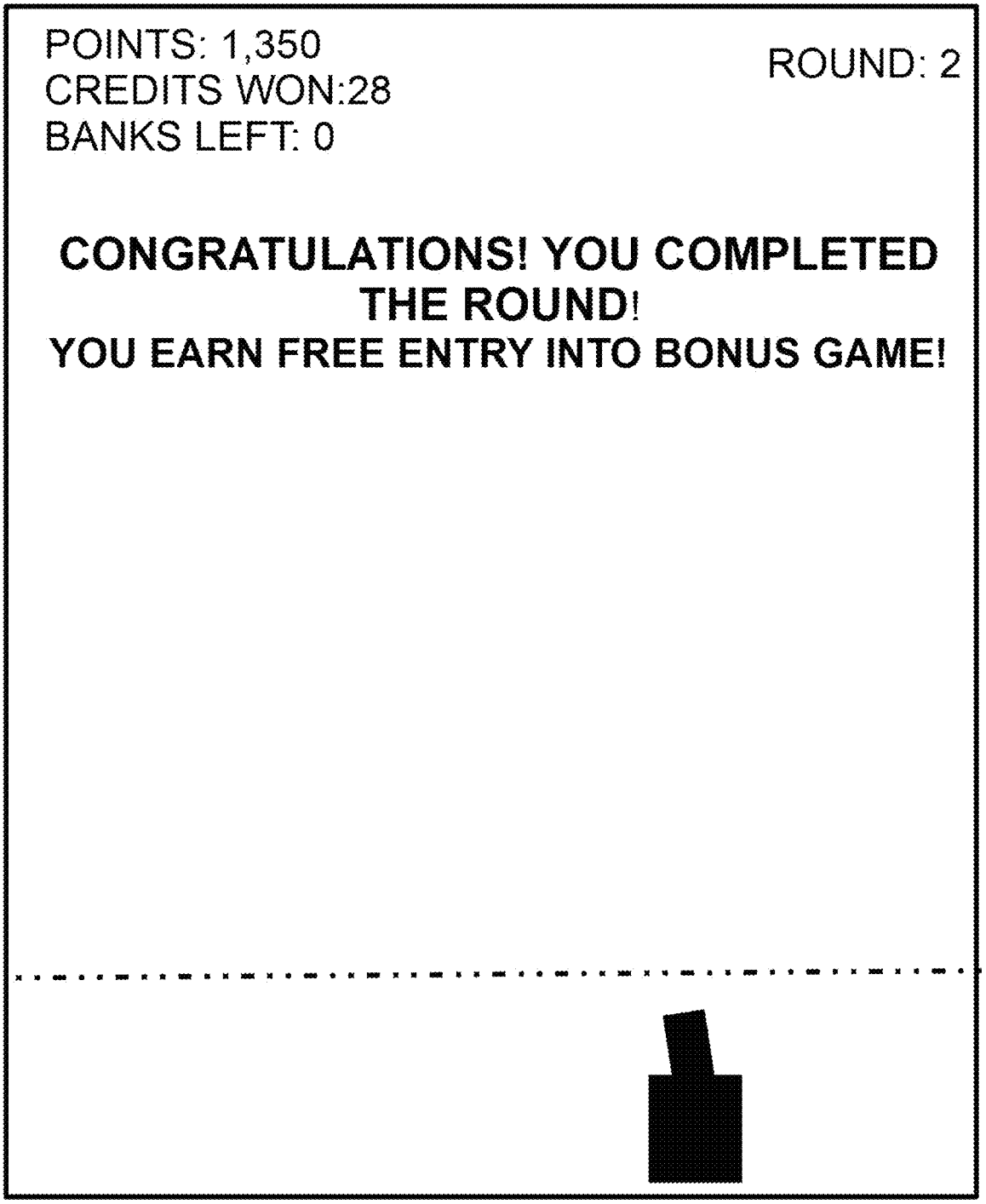
FIG. 9 is a drawing showing a "round completed" screen after the player reaches a checkpoint, according to an embodiment.

FIG. 9 is a drawing showing a "round completed" screen after the player reaches a checkpoint, according to an embodiment.

In this example, the player continued to play, destroys all of the banks and targets (without any target passing below the lose line and without the tank itself being destroyed), and the player (tank) reaches the end of the round (checkpoint) without any of the targets (which includes banks) falling below the lose line. In this particular example, the player has earned a total of 1,350 points from destroying all of the targets and a total f 28 credits from destroying all of the banks.

After the player has reached the checkpoint (without any target falling below the lose line), the player can be presented with a bonus award message/screen informing the player that he/she has reached the checkpoint and is entitled to play the bonus round/game. Typically, the player would not have to pay extra in order to play the bonus round/game. The bonus round/game can be any type of game (typically different from the tank shooting game previously described/illustrated). For example, the bonus round/game can be a slot machine type game (e.g., spinning reels and awarding awards when winning combinations are achieved), although the bonus round/game can be any other type of game as well (e.g., video poker, etc.) The bonus round/game would typically be a non-skill game (in other words skill would not affect the outcome which is purely random). Note that in one embodiment the bonus round/game is always provided to the player. In another embodiment, the bonus round/game is only provided to the player some of the time (e.g., based upon a random determination, e.g., 50% of the time). See FIG. 12 for an example of a bonus round/game.

The amount (e.g., credits) in the error pool (also referred to as "pool") is distributed to the banks during initiation (operation 1101) of a new game. The error pool contains credits (representing "error" that previous players have made by not playing optimally) which is going to be potentially distributed to the next (e.g., current) player who plays the game. 100% of the credits in the pool can be distributed or a portion (e.g., 50%) can be distributed. The credits from the pool are added to the amount assigned to the banks in the upcoming level (when each bank is awarded, it's assigned amount of credits is awarded to the player).

Thus, before a round/level is begun, banks in the round (which are targets that the player can shoot to destroy) are pre-populated with a fixed (predetermined) award amount which is awarded to the player if and when the player destroys that bank. Since all banks (and other targets) will move from the top to the bottom of the screen, the player who completes the round/level will have destroyed all banks (because if a bank reaches the lose line before it is destroyed the level/round will terminate).

Figure 10:
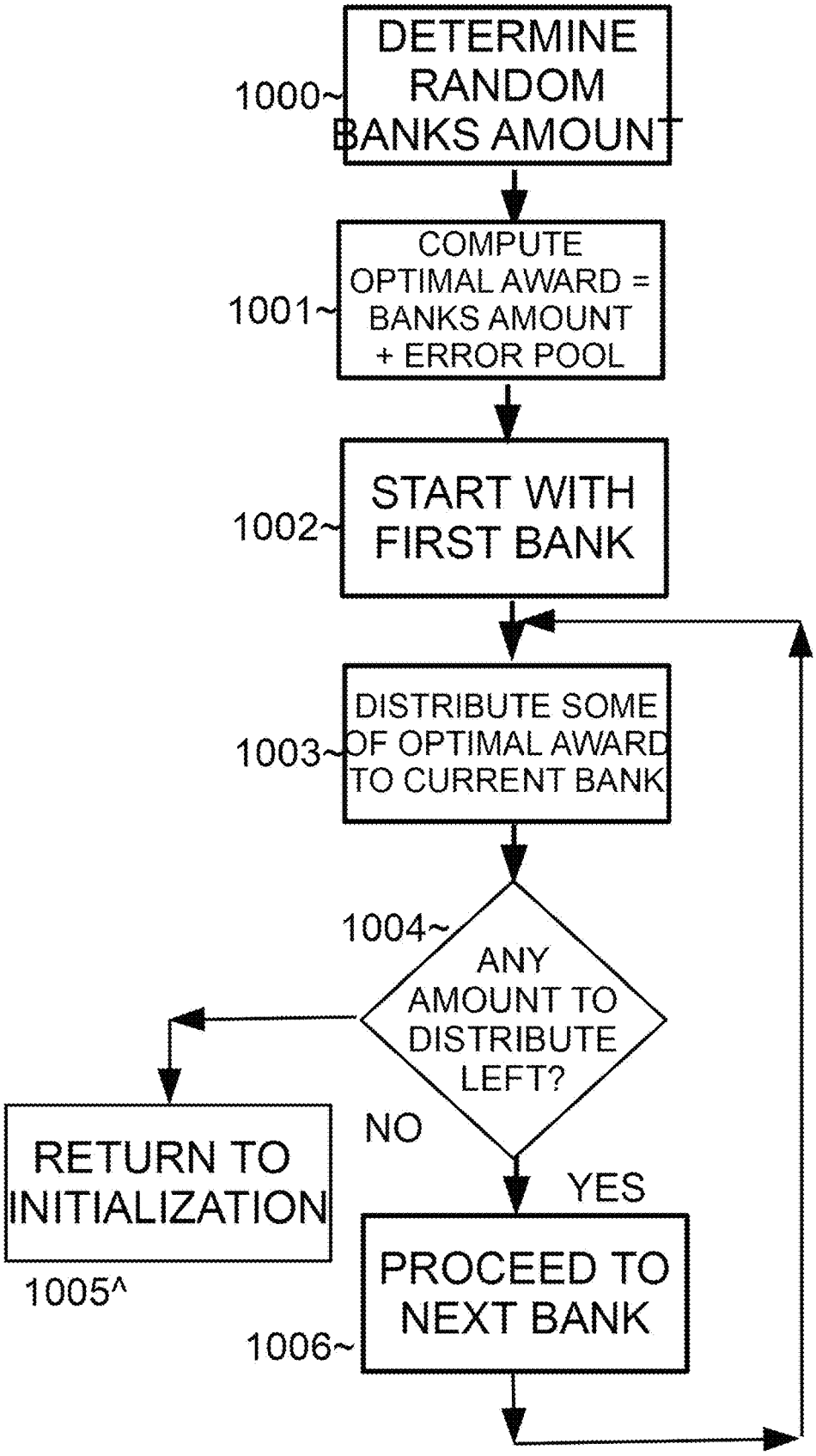
FIG. 10 is a flowchart illustrating an exemplary method of populating bank awards, according to an embodiment.

FIG. 10 is a flowchart illustrating an exemplary method of populating bank awards, according to an embodiment. The method illustrated in FIG. 10 is implemented when operation 1101 (of FIG. 11) is executed. That is, before a round/level begins the banks in that level are pre-populated with award amounts which are awarded only when the player destroys that particular bank.

In operation 1000, the method determines the banks amount randomly. The banks amount is the amount of credits (or other quantity) that will be populated into all of the banks of the level/round (also referred to herein as "level" or "round"). The banks amount is determined randomly and can be determined in numerous ways. For example, the banks amount can be a random number between x and y. For example, if x=10 and y=20 then the banks amount would be a random number between 10 and 20 (inclusive or exclusive). In another embodiment, the banks amount can be determined according to a probability distribution. For example, there can be a 10% chance the banks amount=10, 30% chance the banks amount=20, 40% chance the banks amount=30, 15% chance the banks amount=35, and 5% chance the banks amount=50. Thus, the average banks amount would be easy to compute. In another embodiment, the banks amount is not random but fixed each time (e.g., each level it will be 10 credits, or other amount).

From operation 1000, the method proceeds to operation 1001, which computes the optimal award as the sum of the banks amount plus what is currently in the error pool. The amount currently in the error pool is determined and the error pool is reset (set to zero) with the error pool amount being added to the banks amount to determine the optimal award. In another embodiment, instead of using the entire error pool, a portion of the error pool (e.g., 20%, 50%, 75%, etc.) is used. For example, if the error pool is 100 and the 20% of the error pool is used, then 20 credits (20% of the error pool) is added to the banks amount and the error pool is reduced by 20 credits to be 80 credits (which is then used by the next player).

In one embodiment, the entire pool is used (added to the optimal award) and the pool is reset to zero. In another embodiment, some (but not all) of the pool (e.g., a percentage) is added to the optimal award (and deducting that same amount from the pool to conserve credits). The percentage of the pool used can be fixed (e.g., 50%) or random (e.g., random from 1% to 99%). It can be skill independent (random but not based on the player skill) or skill dependent (random but also based on the players skill, for example based on a number of credits the player has previously with the more credits earned the higher a percentage of the pool the player is awarded). As an example of this latter embodiment, if the player has earned less than 10 credits in the prior game, then 20% of the pool is used, if the player has earned 10 credits to 20 credits in the prior game then 50% of the pool is used, and if the player has earned more than 20 credits in the prior game then 75% (or 100%) of the pool is used. This can also be reversed so the less credits earned by the player would have the higher usage of the pool. This could help avoid the "poker syndrome" where only very few players won the money.

Thus, the optimal award is determined to be the sum of what is taken from the error pool plus the random banks amount determined in operation 1000. The optimal award is the amount of credits that the player would win if the player plays the level optimally (destroys all targets including all banks) and reaches the checkpoint. The optimal award is spread over all of the banks in the upcoming level. When a bank is destroyed, the award amount for the destruction of that bank has already been determined by the method in FIG. 10 (before the round starts). Thus, while each player may think the award awarded upon the destruction of each bank is randomly determined at the point of destruction, it actually has already been determined (but not yet displayed to the player). So, a player who destroys all banks will win the optimal award. A player who loses the level before destroying all banks will not win the optimal award but will have won however many credits were in (assigned to) the banks that the player had destroyed during play of the level.

Note that the player pays an amount in credits (in operation 1100) to play the level and the banks amount is randomly determined. Thus, the average (expected) banks amount/the wager received (in operation 1100) to play the level is the actual return to the players (RTP) in the long run. For example, if the wager received in operation 1100 is $10 and the average banks amount is $9, then the average RTP is 90%. Players who play optimally will approach this RTP. Players who do not play optimally will have their error contributed to the error pool which is then distributed to other players so that in the long run, the global (game-wide across all players over time) RTP given to the players would be fixed.

From operation 1001, the method proceeds to operation 1002, which starts with the first bank (in other words the current bank equals 1). There can be n (a fixed quantity) of banks in the level (ordered in a linear sequence), and a current bank used would be 1 (the first bank). Each bank in the sequence will be assigned a random amount so that all of the optimal award is distributed to all (or some) of the banks in the level. Note that in operation 1002, an amount let to distribute equals the optimal award and is used as a temporary variable to help assign a credit value to all of the banks.

From operation 1002, the method proceeds to operation 1003, which distributes some of the optimal award to the current bank. This can be done by taking a random number (e.g., 0 to 10 or other range) and assigning that random number to the current bank. The amount assigned to the current bank is deducted from the amount left to distribute so that the amount left to distribute reflects how many credits still need to be assigned to other banks. When the amount left to distribute equals zero, this means all of the optimal award has now been distributed (allocated) to the banks. If the random number is higher than the amount left to distribute, then the random number would be equal to the amount left to distribute. Note that if the current bank is the last bank in the sequence, then all of the amount left to distribute can be assigned to the current bank so there is nothing left to distribute (since there are no further banks left). Note that some banks can have the value of zero (meaning when destroyed they do not generate the player an award), while the majority of banks would have a non-zero award (meaning when destroyed they award the player their respective assigned award which is added to the player's credit meter).

From operation 1003, the method proceeds to operation 1004, which determines whether there is any amount to distribute left. If there is no amount to distribute left (i.e., the amount to distribute equals zero), then the method proceeds to operation 1005, which returns to the initialization operation in FIG. 11.

If in operation 1004, there is still an amount to distribute left (i.e., the amount to distribute is greater than zero), then the method proceeds to operation 1006. In operation 1006, the current bank is incremented so the next bank can be given a distribution. From operation 1006, the method returns to operation 1003.

Note that after operations 1002 to 1006 are implemented, the optimal award (computed in operation 1001) is distributed (assigned) to the banks in the upcoming level. If the player is successful in destroying all of the banks in the level (optimal play), then the player would have won the optimal award.

As an example of the method illustrated in FIG. 10, assume the banks amount is defined as a random number between 10 and 20 and in this example is randomly determined to be 15. Also assume that the current error pool contains 6 and the algorithm uses 50% of the error pool (although it can be any other positive non-zero number such as 100%, etc.) So 50% of the error pool would be 3 which is added to the banks amount (15) resulting in an optimal award of 18. Thus, if the player is to player the round/level optimally (reaching the checkpoint), the player would win 18 credits. Assuming the level has five banks, the 18 credits in the optimal award can for example be assigned by the algorithm as follows: bank 1=8 credits; bank 2=5 credits; bank 3=0 credits; bank 4=3; bank 5=2. Thus, as the player plays, if he/she destroys the first bank the player would be awarded 8 credits, if/when the player destroys the second bank the player would be awarded 5 credits, and so on. If the player plays optimally the player would have destroyed all of the five banks and earned 18 credits. Thus, the sum of all of the awards assigned to the banks would equal the optimal award determined in operation 1001. This distribution across the five banks is random and would typically be different each time the game is played (even with the same amount of credits being the optimal award).

Note that the method illustrated in FIG. 10 is merely one method to assign credit amounts to banks and other methods could be used as well. Note that the amounts assigned to banks are assigned using random numbers and thus no two games would ever be the same (but for a very unlikely coincidence). Thus, in general, the method would first determine the optimal award, and then "backtrack" and break up the optimal award into smaller awards which are each assigned to respective banks in the upcoming round/level (the sum of all of the bank's awards then would total the optimal award).

Figure 11:
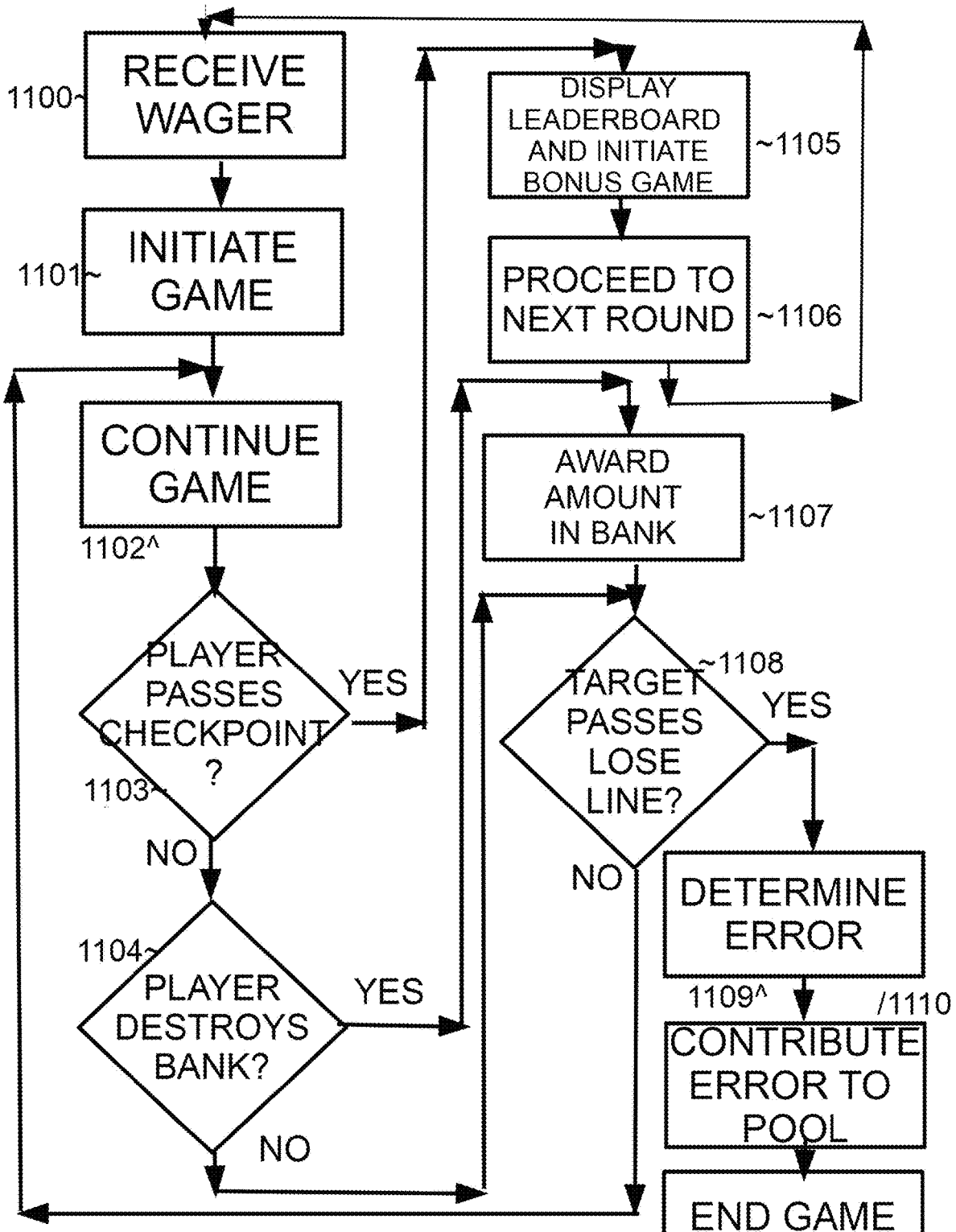
FIG. 11 is a flowchart illustrating an exemplary method of implementing an arcade game with error banking, according to an embodiment.

FIG. 11 is a flowchart illustrating an exemplary method of implementing an arcade game with error banking, according to an embodiment.

In operation 1100, a wager is received from the player to play the game. The wager can be in the form of credits, which are purchasable from cash and can be redeemed (cashed out) for cash. For example, players can send money to the server hosting the game (via credit card, crypto-coin, electronic funds transfer, etc. and purchase credits). The credits are then used to play the game (e.g., each time the game is played a credit cost is deducted from the player's credit meter. The credit meter reflects a total amount of credits the player currently has. When the player wishes to cash out, the player can indicate his/her desire to cash out via pressing a button, etc., and some (or all) of the player's credits are converted into money (equivalent to cash) that then can be withdrawn to another player's account (e.g., bank account, etc.) by electronic transfer of funds.

So, for example, if the game costs 100 credits to play, then in operation 1100, the player's credit meter is deducted by 100 credits. If the player does not have enough credits then the player cannot play the game and would have to deposit more money (which is converted into credits). The amount paid in operation 1100 is to play an entire level. Once the wager amount is received in operation 1100, no further amount needs to be paid to the game by the player in order to complete the level. Once the level is completed (successfully or unsuccessful by the player), then the player would need to pay an additional amount to play another level (also referred to as "round").

From operation 1100, the method proceeds to operation 1101, which initiates the game. the method illustrated in FIG. 10 is implemented in order to pre-populate all of the banks in the upcoming level to be played with award amounts. Once each bank is populated with its award amount, that award amount will not change throughout the level.

The game (for example what is shown in FIG. 2) is displayed and the computer-generated animation begins (the game is entirely generated using computer animation on an electronic output device and is controlled by the player using one or more physical input device(s)).

From operation 1101, the method proceeds to operation 1102, which continues play of the game. The game play is generally as described herein, wherein targets scroll from the top of the screen to the bottom. The player controls a tank (the tank as used herein can be any other icon, such as a spaceship, plane, person, etc.) which can move forward/backwards along one axis (e.g., left/right, or up/down) or optionally can move along both axes (e.g., can move both up/down and left/right) and can aim a cannon (or other launcher) attached to the tank. The player chooses when and which direction to shoot projectiles (e.g., bullets, missiles, etc.) out of the cannon (by using an input device such as a button, joystick, mouse, etc.) and would typically try to destroy all of the targets before they reach the lose line. Each time a target is destroyed the player would earn points (added to a point total), which have no monetary value but can add to the excitement of the game.

During play of the game in operation 1102, the players will attempt to shoot at targets (when hit a target is destroyed and disappears). Banks are a type of target, and when banks are destroyed by the player then the player is entitled to earning however many credits that destroyed bank has been assigned (could be zero or non-zero). Each bank is pre-assigned (before the round begins) an amount of credits which would be awarded to the player upon destruction of the bank. More on the assigning a credit amount to each bank is discussed herein with regard to FIG. 10.

In one embodiment, the tank (or other object that the player is controlling, such as an airplane, avatar, spaceship, etc.) is indestructible. In another embodiment, the tank (or other object) is destructible and can be destroyed upon one (or multiple) impacts with targets (or projectiles being shot at the tank by the targets). "Enemy fire" (projectiles launched by the targets including banks) can also destroy the tank (or decrease its health amount). The tank can also have a health amount (e.g., 1 to 10) and upon each impact of the tank the health amount would decrease and when the health amount reaches zero the tank is destroyed and the level/round ends (e.g., thus the tank would take 10 (or other amount) of hits before the tank is destroyed). Thus, if the tank is destroyed, then this is equivalent to a target passing the lose line, which ends the round. Thus, the player needs to skillfully choose his/her targets to shoot at carefully, that is choose between targets which are approaching the lose line and other targets which are attacking the tank.

While the game is being played in operation 1102 (simultaneously with operation 1102 or in periodic intervals), it is determined in operation 1103 if the player passes a checkpoint. This means the player has played the game for (depending on the embodiment): a predetermined time, or a predetermined vertical distance, or destroyed all targets (including all banks), or reached a checkpoint and remained alive (no target passed below the lose line) thereby resulting in the player passing the current checkpoint (completing this stage of the game). Note that if the player reaches/passes the checkpoint this means that the player must have destroyed all of the targets (because if a target was not destroyed then it would pass the lose line and the game would have terminated). Banks are considered targets. Thus, if the game reaches the checkpoint then the player has played optimally (and would have collected all of the awards in all of the banks which equal the optimal award). If the player has passed the checkpoint, then the method proceeds to operation 1105.

If in operation 1103 the player has not yet passed the checkpoint, then the method proceeds to operation 1104 which determines whether the player has destroyed a bank. When a bank is destroyed then the method proceeds to operation 1107. Note that if another target is destroyed (besides a bank) then destroying that target would result in the player earning points (but no credit award).

If in operation 1104 the player does not destroy a bank, then the method proceeds to operation 1108, which determines whether a target (any target being displayed) passes the lose line (and hence if the round is over). That is, a target has touched or fallen below the lose line. If no target has passed the lose line, then the round (level) is not over, and the method returns to operation 1102, which continues play of the game. Note that if the tank (what the player is controlling) is destroyed, then this has the same effect as if a target has passed (reached) the lose line and hence the method proceeds to operation 1109. If the tank is not destroyed (and no target has reached/passed the lose line) then the method returns to operation 1102. Note that play of the game would continue indefinitely until the round is completed (operation 1105) or terminated without playing optimally (operation 1109).

If in operation 1103, the player passes a checkpoint, then the method would proceed to operation 1105, which completes the round/level. The player must have destroyed all of the banks in the level and so the player has received the optimal award (in credits). A leaderboard can be displayed displaying the player's name (real name or username) and score to all of the players playing the game. Then the game could initiate a bonus game. Each round (a round/level is a segment of the game which ends in a checkpoint) has an optimal award which is the sum of all of the awards pre-assigned (see FIG. 10) to the banks in the round. Note that each round/level has only one checkpoint which when reached would end the round/level.

In addition to the player receiving credits for reaching the checkpoint, the player can also be presented with a bonus game in which the player would play and earn additional credits. The bonus game can be any game in which the player could earn a random amount of credits, for example a slot machine game which spins reels to a random results and determines whether the game is a winner (and how much) by comparing the resulting symbols to a paytable (as known in the art). For example, the player can be provided with a number of free spins on the slot machine game (e.g., 5 free spins) as the bonus game.

From operation 1105 (after the player has received a credit award for reaching the checking and played the bonus game (and received any awards the player may have won in the bonus game), then the method proceeds to operation 1106 which proceeds to the next round. Since the player completed the level/round, the player can now be advanced to a next level/round. The game still returns to operation 1100 in that in order for the player to play the next level/round the player would still have to pay the entree fee (wager) in operation 1100. Note that when the player has reached the checkpoint (and reaches operations 1105/1106, the player has played optimally (and received the maximum/optimal award for the level and thus there is no contribution to the error pool.) The new level can have different graphics, etc., but the gameplay remains the same as described herein. The new round can be the same targets and scenery or can be new targets and/or scenery. Each round typically plays with the same game play and operations as described herein.

In operation 1104, if the player destroys a bank, then the method proceeds to operation 1107. In operation 1107, the player is awarded the amount that was assigned to the bank that was just destroyed (e.g., the player's credit meter is increased by the amount (in credits) that was already assigned to that bank).

After the player is awarded the amount in the bank in operation 1107 (and also from operation 1104 if the player had not destroyed a bank), the method then proceeds to operation 1108 which determines if a target has passed (goes on or below) the lose line (in other words if the round is over). If any target passes the lose line, then the round is terminated (without the player playing optimally) and the method proceeds to operation 1109. If no target has passed the lose line, then the method returns to operation 1102 which continues the game. If the tank is destroyed, then this has the same effect as if a target passes the lose line. If the tank is not destroyed, then this typically has no effect on the gameplay. In another embodiment, from operation 1107, the method can continue to operation 1102.

If operation 1109 is reached, the level/round has terminated (either by a target passing the lose line or the tank being destroyed) without the player destroying all of the banks. Thus, the player has not earned the optimal award, and thus the error is added to the pool (also referred to as error pool).

In operation 1109, the error is determined. The error is the optimal award in credits (as determined in operation 1001) for the current round minus the actual amount of credits that the player has won in the current round (the actual award). Had the player played optimally, the player would have won the optimal award. Since the player did not play optimally, the error is the different between if the player played optimally (the optimal award) and what the player actually earned in credits from destroying the banks. This error can be returned back to other players (in the manner described herein). Thus, for example, if the optimal award for the particular round was $100, and the player only earned $20 (by destroying two banks each worth $15 and $5), then the error is $100−$20=$80 (credits are interchangeable/equivalent to dollar amounts).

Thus, each round provides an optimal award which the player can earn if the player plays perfectly (and destroys all banks/reaches the checkpoint). However, since the majority of players will not play perfectly, the error is computed (as optimal award minus actual award) and contributed (added) to the pool. The game can, for example, pay back (RTP) 95% of the player's wager to the players (over time utilizing many players) by virtue of banking the player's error in the pool for the subsequent player(s) to potentially earn. The optimal award could be a value between $1 and $100,000 (very rare) but regardless whatever the optimal award was determined would be "given back" to the player who is playing for the optimal award (and if that player does not achieve the optimal award then the error is given to subsequent player(s)) thus preserving the RTP. Thus, a fixed RTP can be guaranteed over time. Note that many players (around the world via the internet) would typically be playing the game simultaneously (or in close temporal proximity), so the error pool would fill and get used fairly quickly.

So, for example, a first player would contribute error to the pool, the second player (immediately after the first player) would get this error amount from the pool, and the third player (immediately after the second) would not get anything from the pool because it would be empty by virtue of the second player getting the error pool (and presumably not putting anything back into the pool).

The actual award is the amount of credits the player earned playing the current round (in other words the sum of all of the awards for all of the banks destroyed in the current round) in this case before the player has destroyed all of the banks.

The error is then computed as the optimal award minus the actual award. The error is the contributed (added) to the error pool. In other words, if the pool already has an amount of credits in it then the error is added to that amount of credits in the pool (e.g., the pool grows). The error pool is shared by all players who are playing the game. Thus, the next players to play later round/s would potentially be awarded some or all of the error pool. Note that each round would have its own error pool. In another embodiment, all rounds would share the same error pool.

From operation 1110, the method proceeds to operation 1111, which ends the game. The player is free to begin a new game which would return to operation 1000.

Figure 12:
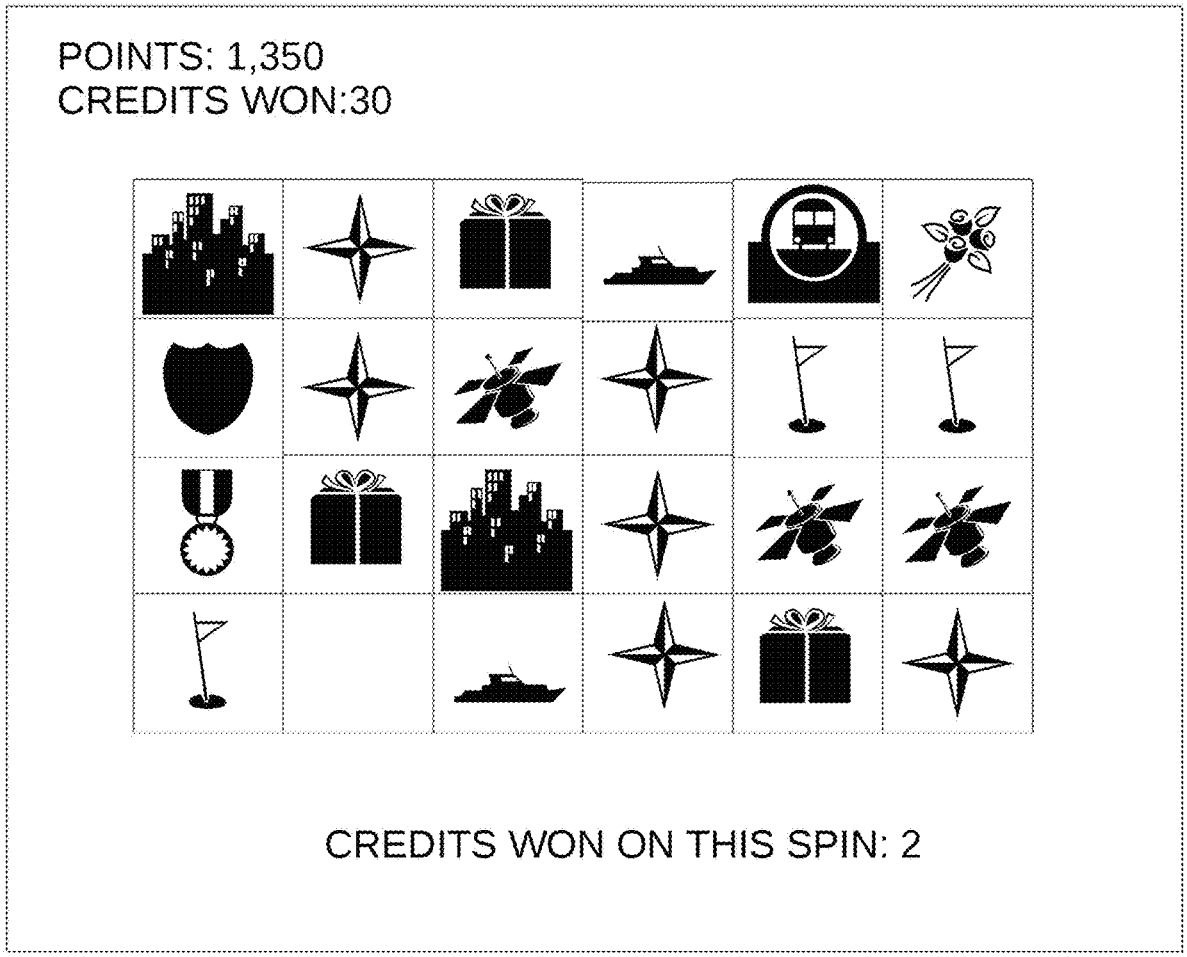
FIG. 12 is a drawing of a slot machine game which can be used as a bonus game, according to an embodiment.

FIG. 12 is a drawing of a slot machine game which can be used as a bonus game, according to an embodiment.

Note that in one embodiment, there is no bonus game and in operation 1105 no bonus game is presented to the player. In another embodiment, there is a bonus game which is always (or sometimes, determined randomly) presented to the player (in operation 1105) where the player can win additional credits.

In operation 1105, the player is provided a bonus game in which the player can earn extra credits (which can be exchangeable for cash). The player can, for example, be provided a number of free spins on the slot machine (e.g., 10 or any other number).

As known in the art, a slot machine operates by spinning reels to a random stopping position, and then comparing symbols on the stopped reels across paylines to determine whether a winning combination is present or not. A paytable is used to determine the payouts for winning combinations. The bonus game can play the slot game a predetermined number of times for free without requiring any credits or other payment from the player. Winning spins will add credits to the player's credit meter (total amount of credits). In this example, the player has won 2 credits from the reel spin which is added to the player's credit meter. The award from the bonus game/round is not coming from the error pool.

Figure 13:
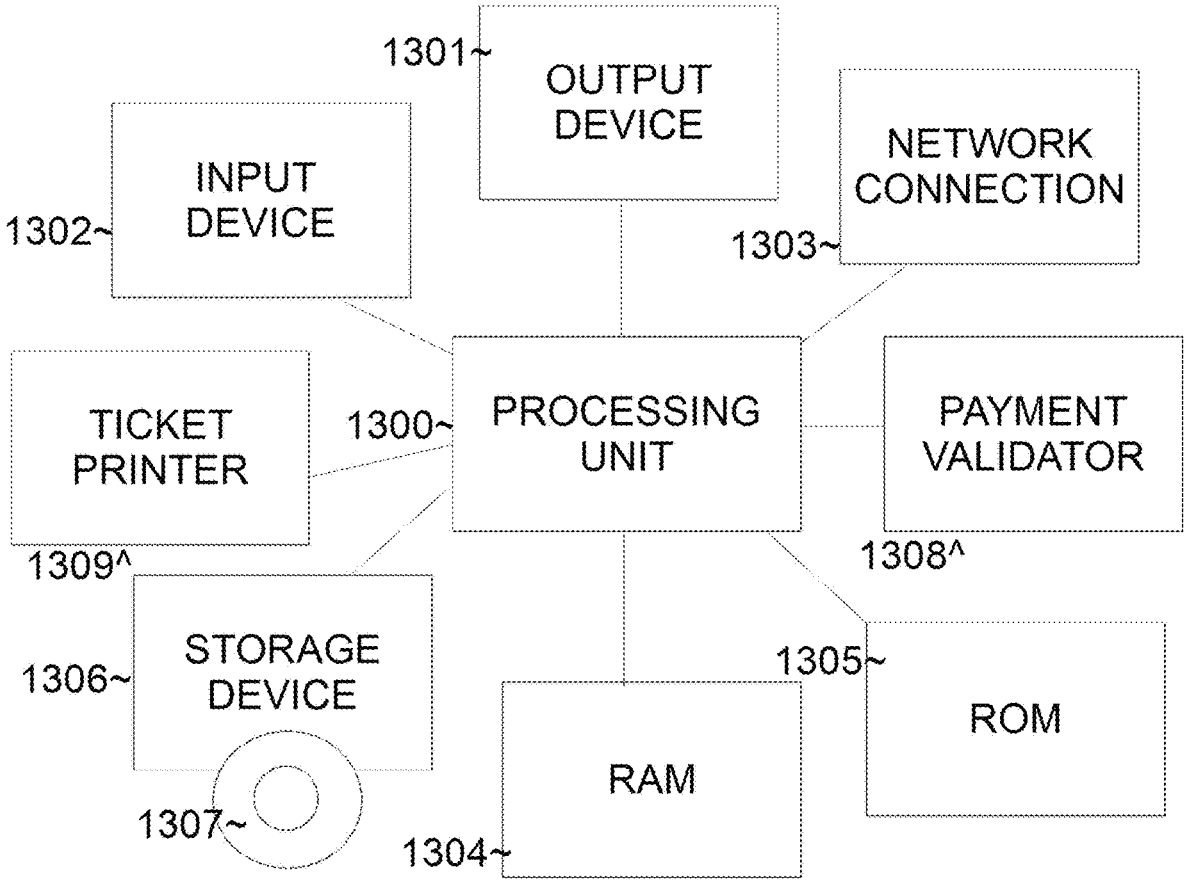
FIG. 13 is a block diagram illustrating exemplary hardware that can be used to implement the game described herein, according to an embodiment.

FIG. 13 is a block diagram illustrating exemplary hardware that can be used to implement the game described herein, according to an embodiment. The hardware in FIG. 13 can be used to implement a computer implementing the game described herein (e.g., implement an online casino utilizing real money wagers and payouts) and/or a server that is serving the game to a computer which is displaying the game to a player. Such a server can optionally interface with a social networking site (e.g., FACEBOOK, MYSPACE, etc.) that is used to coordinate the entire game and communicate with the players as well as a server used by the social network site. The hardware can also be, for example, an electronic gaming machine (EGM) used in casinos such as a video slot machine. The hardware can also be a server implementing an online casino which servers a large number (e.g., 1-1000 or more) of simultaneous remote players as well as a larger number of players who have an account with the online casino who many not be playing at a particular time. The hardware can also be a personal computer or personal computing device (e.g., laptop, desktop, cell phone, tablet, etc.) playing the game using the Internet. The hardware can also be any other type of device, working individually or in conjunction with other devices.

A processing unit 1300 (such as a microprocessor and any associated components) is connected to an output device 1301 (such as an LCD monitor, touch screen, CRT, etc.) which is used to display to the player any aspect/output/state of the method, and an input device (or multiple devices) 1302 (e.g., buttons, a touch screen, a keyboard, joystick, mouse, etc.) which can be used to input from the player any decision/input made by the player. For example, the tank (or other avatar) can be controlled with a joystick (both the direction of movement as well as the direction of aiming), and a button on the joystick can fire a projectile out of the tank. All methods described herein can be performed by the processing unit 1200 by loading and executing respective instructions which are programmed accordingly. Multiple such processing units can also work in collaboration with each other (in a same or different physical location). The processing unit 1300 can also be connected to a network connection 1303, which can connect the electronic gaming device to a computer communications network such as the Internet, a LAN, WAN, etc. The processing unit 1300 is also connected to a RAM 1304 and a ROM 1305. The processing unit 1300 is also connected to a storage device 1306 which can be a disk drive, DVD-drive, CD-ROM drive, flash memory, etc. A non-transitory computer readable storage medium 1307 (e.g., hard disk, CD-ROM, solid state drive, or any other non-transitory medium which can store computer readable instructions), can store a computer readable program which (when executed) can control (and cause) the electronic device (and/or the processing unit 1300) to perform any and all of the methods described herein, and can be read by the storage device 1306 and written to by the storage device 1306.

The processing unit 1300 can also be connected to a payment validator 1308. The payment validator can be a bill acceptor which accepts currency, identifies it as being valid (typically by using an optical scanner), and then credits the inserted bill amount to the machine (for example inserting a $10 bill will credit the machine with $10 in credits). These credits can be used to play the games (e.g., pay for a spin). The bill acceptor can also accept cashless tickets as part of a 'ticket-in-ticket-out" system, in which tickets (cashless vouchers) have cash value and can be inserted into the payment validator 1308. The validator 1308 validates the ticket (typically be optically scanning a bar-code), communicating electronically with a casino database to verify the ticket is authentic, and once authenticated then crediting the machine with the respective amount of credits. The payment validator 1308 can also include a card reader which can read cards (e.g., with a magnetic stripe or other electronic encoding) so that an account number can be accessed. The cards can be a credit card, player loyalty card, specific casino payment card, or any card that can provide electronic access to a monetary amount owned by the player (owner of the card) which the player can utilize for depositing money and then playing the machine. If such a card is used, then the player can optionally enter (using a keypad) an amount the player wishes to withdraw from the account associated with the card to credit to the machine. The player can also the card in this matter to request that the machine electronically transfer any credits on the machine (e.g., credits) to the player's account associated with the card.

The processing unit 1300 can also be connected to a ticket printer 1309 which can print tickets (cashless vouchers). When the player cashes out on the machine (indicated to the machine that the player wishes to cash out and terminate by, typically by pressing a button), a ticket is printed by the ticket printer 1309 which carries (can be redeemed for) the amount of credits left on the machine in the credit meter. This ticket can then be used to play other machines in the casino by inserting them into that machine's payment validator. The ticket can also be used to redeem for cash by inserting it into a ticket redemption machine (kiosk) which receives a ticket, validates it (typically by scanning the barcode), and then dispenses an identical amount of cash to what the ticket's value is. Note that at any time during play, the player can cash out (typically by pressing a cash out button) all of the credits shown in the credit meter into numerous forms which are cash or can be redeemed by cash by the player, such as cash, coins, a cashless ticket, an electronic payment, crypto-currency, etc.

While one processing unit is shown, it can be appreciated that one or more such processor (processing units) can work together (either in a same physical location or in different locations) to combine to implement any of the methods described herein. Programs and/or data required to implement any of the methods/features described herein can all be stored on any non-transitory computer readable storage medium (volatile or non-volatile, such as CD-ROM, RAM, ROM, EPROM, microprocessor cache, etc.)

Note that if the embodiments described herein are implemented as an electronic gaming machine (EGM) then it may be necessary for the machine to be approved by the regulatory authorities (e.g., the Nevada State Gaming Commission) to ensure they have a suitable return to player (RTP) and are honest. Such approval includes inspection of the hardware, software, play-testing, evaluation of the random number generators (either hardware or software), etc. Once the machine has been approved from a rigorous testing will it be officially approved by a regulatory authority and then can appear in that jurisdiction's gaming floor.

Figure 14:
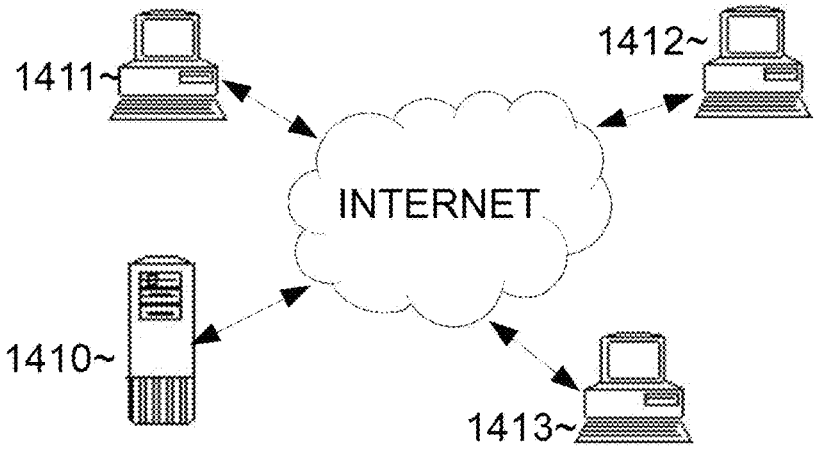
FIG. 14 is a network diagram showing a network structure for an online casino and players, according to an embodiment.

FIG. 14 is a network diagram showing a network structure for an online casino and players, according to an embodiment.

A computer communications network (such as the Internet) can be used to connect an online casino server 1410 which can host and serve an online casino and implement a game as described herein via the internet. Note that while FIG. 14 shows only one online casino server 1410, the casino server 1410 can encompass numerous servers all cooperating with each other (whether in the same physical location or not). The casino server 1410 communicates with players 1411, 1412, 1413 through the Internet (or other computer communication network) and can remotely implement any of the methods/games described herein by executing computer code programmed accordingly. As such, the methods/games described herein can be offered at an online casino for credits which are exchangeable for real money.

All components herein can be distributed across different such components as needed. For example, a single server as mentioned herein can be distributed across numerous different servers and locations. A processor (or processing unit) can also be distributed across multiple processors in a same or different computer (at a same or different location). The electronic components described herein represent an abstraction but it can be appreciated that the computer systems implementing the methods herein can be more numerous and interconnected than illustrated herein.

If a player is playing the game described herein on a social networking site or other type of hosted environment, then the player's computer would cooperate with the social networking server in order to present the game to the player. The player's computer would perform the instructions necessary to display the game while the remote server can determine the results (e.g., the final arrangement) and communicate this result via the Internet to the player's computer so that the player's computer can accurately display the result. The remote server may track and account for all credits wagered and won/lost while the player's computer can display the amount of credits owned or won at the direction of the remote server so the player cannot tamper with these amounts. All games described herein are considered to be played on the site described herein.

Any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer. All variations and features described herein can be combined with any other features described herein without limitation. Note that "wager" and "bet" as used herein are generally synonymous with each other.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An apparatus to implement a game, the apparatus comprising:

an electronic output device and an electronic input device;

an electronic storage device configured to read a non-transitory computer readable storage medium which stores computer readable instructions; at least one processing unit connected to the electronic output device, the electronic input device, and the electronic storage device, the at least one processing unit configured to utilize the electronic storage device to read and execute the computer readable instructions which are programmed to cause the at least one processing unit to:

receive a wager from a player in credits;

determine an optimal award in credits; allocate the optimal award among a plurality of credit awarding targets; implement a game round which comprises display targets falling towards a lose line, and when a target reaches the lose line the round terminates, wherein if a player reaches a checkpoint without any target reaching the lose line then the round ends, wherein each time the player destroys one of the plurality of credit awarding targets in the game round the player is awarded a respective award in credits;

wherein if the round terminates without the player destroying all of the credit awarding targets then an error is determined which is computed as the optimal award minus an actual award earned in credits by the player in the round, and the error is contributed into a pool.

2. The apparatus as recited in claim 1, wherein the computer readable instructions are further programmed such that the optimal award is determined by adding a randomly determined banks amount plus what is currently in the pool.

3. The apparatus as recited in claim 2, wherein the computer readable instructions are further programmed such that the amount in the pool is reset to zero.

4. The apparatus as recited in claim 1, wherein the computer readable instructions are further programmed such that the optimal award is determined by adding a randomly determined banks amount plus a portion of what is currently in the pool.

5. The apparatus as recited in claim 4, wherein the computer readable instructions are further programmed such that the amount in the pool is reduced by the portion.

6. The apparatus as recited in claim 1, wherein the computer readable instructions are further programmed such that some targets award points when destroyed but not credits, wherein credits are redeemable for cash and points have no cash value and are not redeemable for cash.

7. The apparatus as recited in claim 1, wherein the computer readable instructions are further programmed such that if the player reaches the checkpoint then the player also receives play of a free bonus game.

8. The apparatus as recited in claim 7, wherein the computer readable instructions are further programmed such that the bonus game awards credits exchangeable for cash.

9. The apparatus as recited in claim 7, wherein the computer readable instructions are further programmed such that the bonus game is a slot game.

10. The apparatus as recited in claim 1, wherein the computer readable instructions are further programmed such that after the player reaches the checkpoint, the player then is presented with a subsequent round of the game.

11. A method to implement a game, the method comprising:

providing an electronic output device and an electronic input device;

providing an electronic storage device configured to read a non-transitory computer readable storage medium which stores computer readable instructions;

providing at least one processing unit connected to the electronic output device, the electronic input device, and the electronic storage device; executing the computer readable instructions by the at least one processing unit which cause the at least one processing unit to perform: receiving a wager from a player in credits;

determining an optimal award in credits; allocating the optimal award among a plurality of credit awarding targets;

implementing a game round which comprises the operations of: displaying targets falling towards a lose line, and when a target reaches the lose line the round terminates, wherein if a player reaches a checkpoint without any target reaching the lose line then the round ends, wherein each time the player destroys one of the plurality of credit awarding targets in the game round the player is awarded a respective award in credits;

terminating the round without the player destroying all of the credit awarding targets; and determining an error which is computed as the optimal award minus an actual award earned in credits by the player in the round, and the error is contributed into a pool.

12. The method as recited in claim 11, further comprising determining the optimal award by adding a randomly determined banks amount plus what is currently in the pool.

13. The method as recited in claim 12, further comprising resetting the amount in the pool to zero.

14. The method as recited in claim 11, further comprising determining the optimal award by adding a randomly determined banks amount pls a portion of what is currently in the pool.

15. The method as recited in claim 14, further comprising reducing the amount in the pool by the portion.

16. The method as recited in claim 11, wherein the game round comprises functionality that some targets award credits when destroyed while other targets award points when destroyed, wherein credits are redeemable for cash and points have no cash value and are not redeemable for cash.

17. The method as recited in claim 11, further comprising the player reaching the checkpoint and the player then receiving play of a free bonus game.

18. The method as recited in claim 17, wherein the bonus game awards credits exchangeable for cash.

19. The method as recited in claim 17, wherein the bonus game is a slot game.

20. The method as recited in claim 11, the player reaching the checkpoint and then the player then is presented with a subsequent round of the game.

* * * * *